US007147745B1

(12) United States Patent
Slaven, Jr. et al.

(10) Patent No.: US 7,147,745 B1
(45) Date of Patent: Dec. 12, 2006

(54) BAMBOO BEAM AND PROCESS

(75) Inventors: Leland Slaven, Jr., Sarasota, FL (US); Morton A. Siegler, Longboat Key, FL (US)

(73) Assignees: Newcore, L.P., Garden City, NY (US); Madison Insurance Trust, Longboat Key, FL (US)

( * ) Notice: Subject to any disclaimer, the term of this patent is extended or adjusted under 35 U.S.C. 154(b) by 0 days.

(21) Appl. No.: 11/352,821

(22) Filed: Feb. 13, 2006

(51) Int. Cl.
*B32B 31/20* (2006.01)

(52) U.S. Cl. ..... 156/296; 156/256; 156/267

(58) Field of Classification Search ..... None
See application file for complete search history.

(56) References Cited

U.S. PATENT DOCUMENTS 4,137,685 A 2/1979 Fang et al.
4,774,121 A 9/1988 Vollenweider, II
4,810,551 A 3/1989 Chu
4,857,145 A 8/1989 Villavicencio
5,151,238 A 9/1992 Earl et al.
5,271,996 A 12/1993 Tanabe et al.
5,397,067 A 3/1995 Akiyama et al.
5,415,821 A 5/1995 Irie et al.
5,441,787 A 8/1995 Fujii et al.
5,456,964 A 10/1995 Tamura et al.
5,505,238 A 4/1996 Fujii et al.
5,543,197 A 8/1996 Plaehn
5,738,924 A 4/1998 Sing
5,759,463 A 6/1998 Chang
5,786,063 A 7/1998 Shibusawa et al.
5,814,170 A 9/1998 Shibusawa et al.
5,876,649 A 3/1999 Ryan
5,882,745 A 3/1999 Mi et al.
5,972,467 A * 10/1999 Washo ..... 428/107
5,976,644 A 11/1999 Sanaee et al.
5,980,672 A 11/1999 Ryan
6,010,585 A 1/2000 Fujii et al.
6,086,804 A 7/2000 Akiyama et al.
6,098,680 A * 8/2000 Nien ..... 144/380
6,197,414 B1 3/2001 Kawai et al.
6,281,148 B1 8/2001 Dagher et al.
6,383,652 B1 5/2002 Templeton et al.
6,391,435 B1 5/2002 Akiyama et al.
6,513,292 B1 2/2003 Kumon
6,564,837 B1 5/2003 Lou
6,576,331 B1 6/2003 Ryan
6,641,885 B1 11/2003 Lou
6,689,298 B1 2/2004 Yoshida
6,737,006 B1 5/2004 Grohman
6,841,231 B1 1/2005 Liang et al.
6,929,841 B1 8/2005 Van Dijk et al.
2003/0079804 A1 * 5/2003 Hsu ..... 144/350
2003/0207098 A1 11/2003 Ryan
2004/0191448 A1 9/2004 Wu
2005/0048273 A1 3/2005 Ryan
2005/0087904 A1 4/2005 Bryan (Continued)

*Primary Examiner*—Sam Chuan Yao
(74) *Attorney, Agent, or Firm*—Charles J. Prescott

(57) ABSTRACT

Bamboo building material and process of manufacture therefor. The material includes a plurality of layers each formed of bamboo segments which have been dried and glue coated. The segments are substantially free of outer nodes and husk and inner membrane material prior to application of glue. The longitudinal axes of the segments in each layer are generally parallel to one another, each layer having segments oriented generally orthogonally with respect to the next adjacent layers thereto. The layers of segments being compressed and bonded together until the glue cures into a single integral structure.

1 Claim, 4 Drawing Sheets

U.S. PATENT DOCUMENTS

2005/0161852 A1 7/2005 Decker et al.
2005/0163990 A1 7/2005 Chang
2005/0173089 A1 8/2005 Liang et al.

* cited by examiner

FIG 1
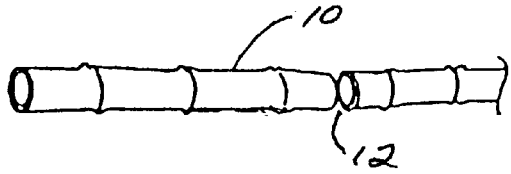
FIG 2
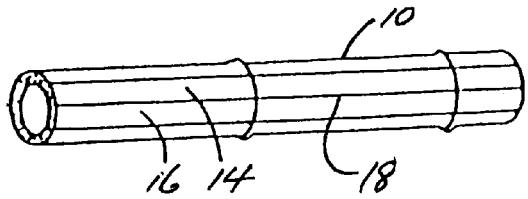
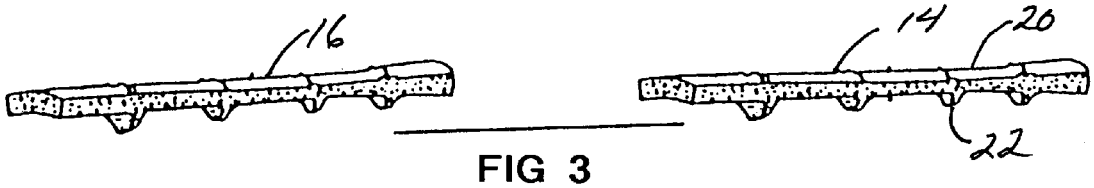
FIG 3
FIG 4
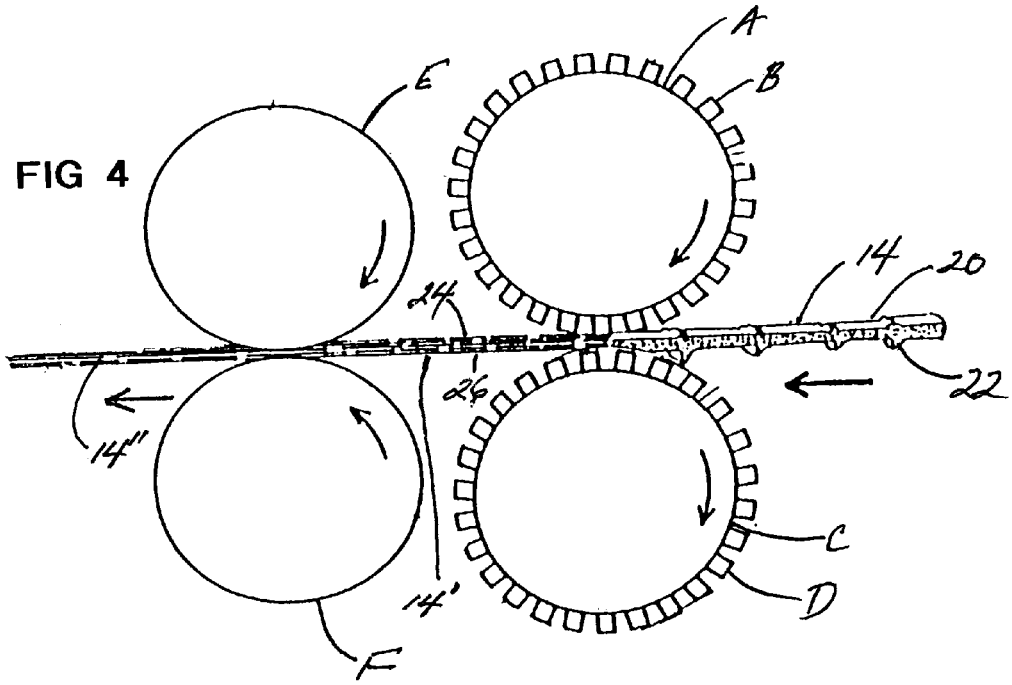

FIG 9
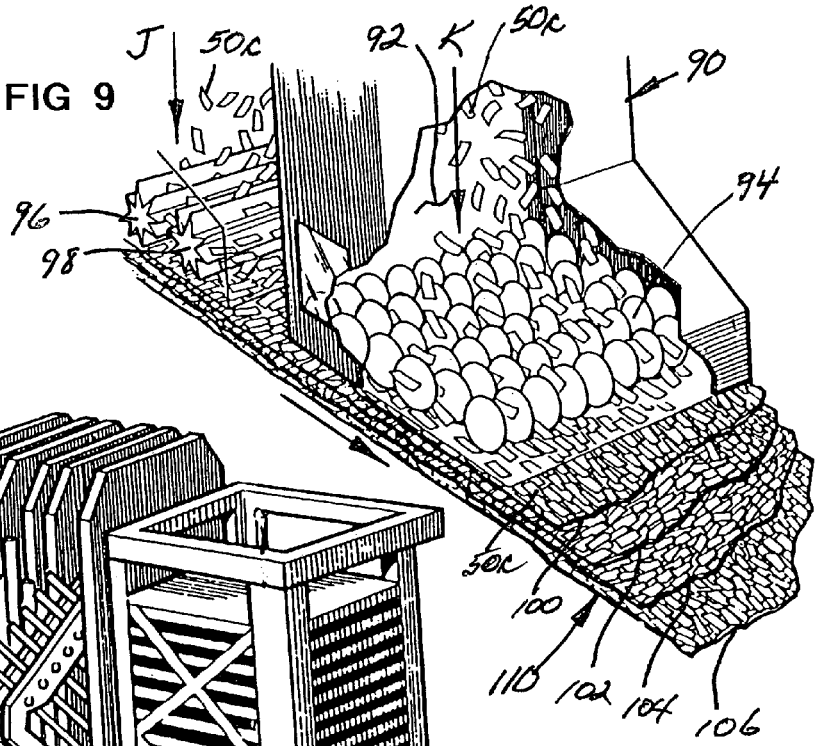
FIG 10
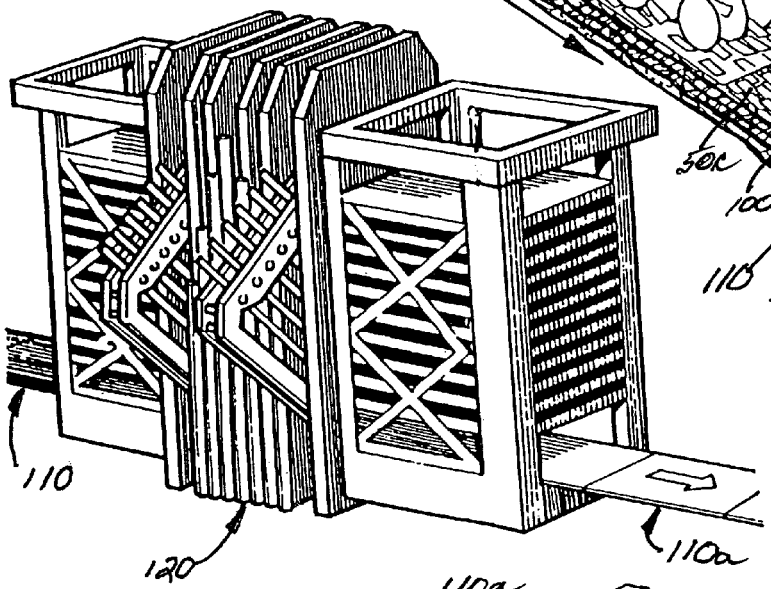
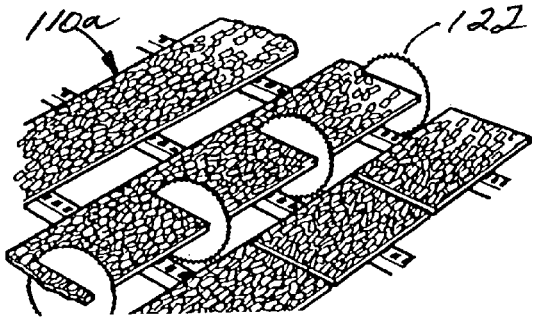
FIG 11

BAMBOO BEAM AND PROCESS

CROSS-REFERENCE TO RELATED APPLICATIONS

Not applicable

STATEMENT REGARDING FEDERALLY SPONSORED RESEARCH OR DEVELOPMENT

Not applicable

INCORPORATION-BY-REFERENCE OF MATERIAL SUBMITTED ON A COMPACT DISC

Not applicable

BACKGROUND OF THE INVENTION

1. Field of the Invention

This invention relates generally to structural wood substitutes, and more particularly to a bamboo beam and process for making same from stranded bamboo segments stripped of all epidermis material and formed into multiple cross oriented layers and bonded under high pressure and temperature into a solid bamboo beam product.

2. Description of Related Art

Because we have, as a world community, substantially depleted the original tree growth in our forests with which we were blessed, manufacturers of wood products utilized in the construction industry have had to resort to next-generation tree growth which, in many cases, produces substantially less wood product as they are necessarily cut down well short of full maturity in size.

Composite lumber formed of wood products such as oriented strand board (OSB) as is described in the SBA Structural Board Association U.S. Edition 2005 Manual, has become a popular substitute for solid wood products. By utilizing substantially all of the wood growth of next-generation forests as facilitated by the OSB process, a very substantial composite wood-based product rivaling the strength of solid wood beams is achievable.

Because of its strength and rapid re-growth cycle, another alternative is to turn to bamboo composite products utilized to form composite wood replacement or alternative beam, plywood and structural products. One particularly interesting bamboo wood replacement product is disclosed in Plaehn, in U.S. Pat. No. 5,543,197. This disclosure teaches a composite bamboo beam which includes segments of bamboo stalk, either split or whole, which are longitudinally aligned and randomly stacked and then compressed and bonded together to form a cohesive bamboo composite structure from which beams of a desired dimension may be cut. Strength consistency is lacking in this bamboo product, however.

The present invention also utilizes bamboo segments in a unique way to develop an even stronger bamboo beam structure for use in the building industry. The process of compressing and final beam formation is taught by Trautner in U.S. Pat. No. 3,723,230, the teaching of which is incorporated herein by reference. Trautner teaches a continuous press for pressing glue-coated consolidatable press charges into structural composite wood structural components.

The significant aspect of the present invention is the recognition that bamboo segments may only be securely glued into a cohesive bamboo composite structure after the outer epidermis surface material and nodes have been machined, abraded or otherwise stripped therefrom. Current glue technology is somewhat inadequate in its binding effect with a bamboo surface which still retains any portion of the epidermis husk or inner membrane material prior to the drying and bonding of the bamboo segments as will be more described more completely herebelow.

BRIEF SUMMARY OF THE INVENTION

This invention is directed to a bamboo building material and process of manufacture therefor. The material includes a plurality of layers each formed of bamboo segments which have been dried and glue coated. The segments are substantially free of outer nodes and husk and inner membrane material prior to application of glue. The longitudinal axes of the segments in each layer are generally parallel to one another, each layer having segments oriented generally orthogonally with respect to the next adjacent layers thereto. The layers of segments being compressed and bonded together until the glue cures into a single integral structure.

It is therefore an object of this invention to provide a composite bamboo structure and beams for use in the building industry as a substitute for solid wood or composite wood products.

It is another object of this invention to provide a composite bamboo beam structure having higher strength ratios than those previously attained.

Still another object of this invention is to provide a multi-layer composite bamboo beam incorporating existing OSB manufacturing technology to produce superior bamboo beam products.

And another object of this invention is to provide composite beam products formed of bamboo segments in multi-layer arrays which clearly exhibits superior glue-to-bamboo segment adhesion by the prior removal of substantially all epidermis materials from the bamboo segments.

In accordance with these and other objects which will become apparent hereinafter, the instant invention will now be described with reference to the accompanying drawings.

BRIEF DESCRIPTION OF THE SEVERAL VIEWS OF THE DRAWING(S)

FIG. 1 is a perspective view a portion of the main stalk or culm of bamboo.

FIG. 2 depicts the longitudinal segmenting of each bamboo stalk segment.

FIG. 3 depicts each of the longitudinally segmented portions of the stalk of FIG. 2.

FIG. 4 depicts the step of removing nodes and epidermis material from both inner and outer surfaces of each stalk segment of FIG. 3.

FIG. 9 shows the orienting and layering of bamboo segments into a composite multi-layer bamboo mat ready for final compressing and bonding into a bamboo structure.

FIG. 10 is a perspective view of the final step of transforming the bamboo multi-layer mat of FIG. 9 into the bamboo structure.

FIG. 11 is a perspective view showing the cutting of the finished bamboo structure into desired sizes.

DETAILED DESCRIPTION OF THE INVENTION

Figure 5:
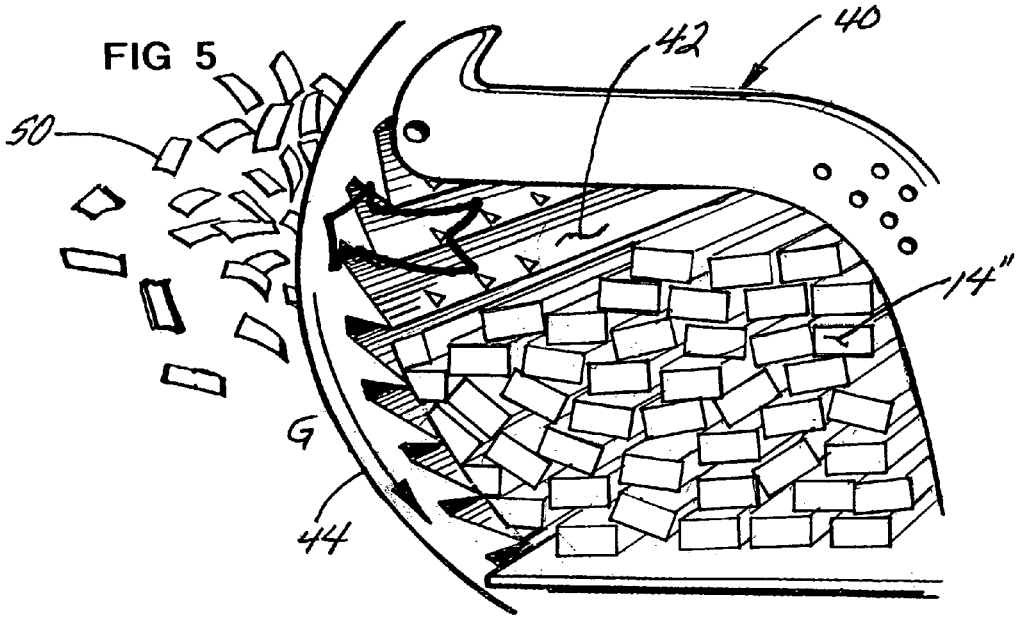
FIG. 5 is a simplified perspective view of the stranding process of each of the bamboo stalk segments from FIG. 4 into bamboo segments.

Referring now to the drawings, and particularly to FIGS. 1 to 4, a portion of a bamboo stalk is shown at numeral 10 in FIG. 1 cut into segments at 12 for further processing. In FIG. 2, each of the bamboo stalks 10 are shown longitudinally segmented by radial inward cuts at 18 to form bamboo slats 14 and 16 as seen in FIG. 3. These longitudinal bamboo slats 14 and 16 have exterior epidermis material on the exterior and interior surfaces 20 and 22, respectively, including nodes on the inner surface 22 which must be removed in accordance with the present invention for achieving consistent superior bond adhesion for strength as described hereebelow.

In FIG. 4, each of the bamboo slats 14 are fed through a pair of abrasion or machining wheels A and C, each of which have radially extending machining tips B and D which rotate in the direction of the arrows to remove all of the green epidermis material from the outer and inner surfaces 20 and 22, including the nodes. The first modified bamboo slats 14', now having stripped outer and inner surfaces 24 and 26 then move on a continuous basis through rollers E and F which compress and flatten and dewater the bamboo slats at 14" ready for further processing. This equipment, commercially called a veneer slicer, is available from Marunaka and Industrial Machinery Sales of Medford, Oreg.

Figure 6:
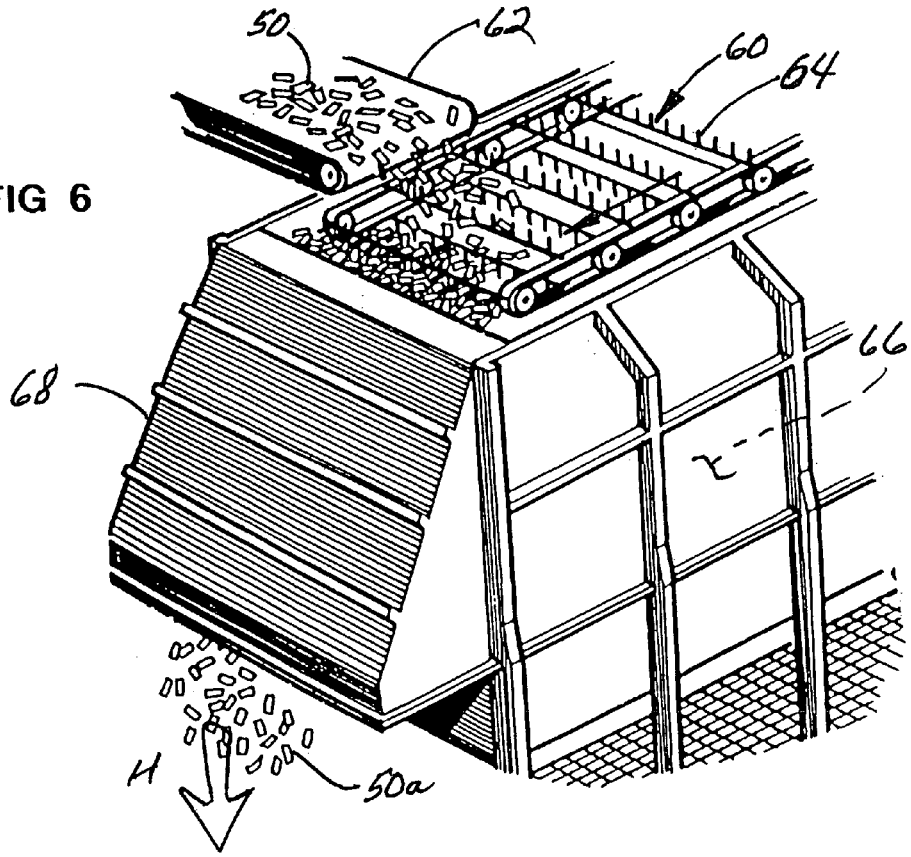
FIG. 6 is a perspective view of the bamboo segments being initially treated for insect and parasite removal.

With a substantial portion of the moisture having been extracted as shown in FIG. 4, the twice-modified bamboo slats 14" are loaded as shown in FIG. 5 into a stranding machine 40 which includes a stranding drum 44 with blades 42 inwardly disposed and which rotates in the direction of arrow G. The stranded bamboo segments shown generally at 50 having a size range of about 0.015"–0.030" in thickness, 1"–2" in width, and 6"–12" in length discharge from the stranding apparatus 40 and are ready for an initial chemical processing as seen in FIG. 6. The bamboo segments 50 are fed by conveyor 62 of apparatus 60 onto a sorting conveyor 64 and chemically treated within the interior chamber 66 to remove all insects and parasites for discharge at 68 in the direction of arrow H, the treated segments being shown generally at 50*a*. Note that apparatus 60 may accomplish this step by boiling, steam or chemicals.

Figure 7:
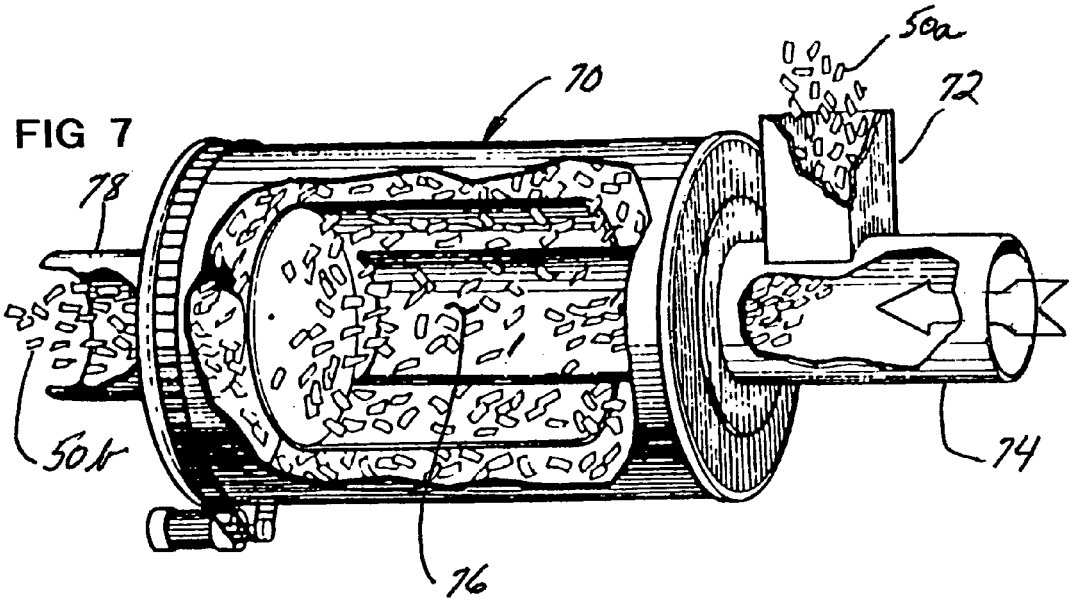
FIG. 7 is a perspective view of the bamboo segment drying process.

In FIG. 7, a continuous drying apparatus 70 receives the bamboo segments 50*a* into inlet chute 72, heated air being forced into the drying apparatus 70 through inlet 74. Both heated air and bamboo segments 50*a* mix and tumble within the chamber 76 to effect complete moisture drying of the bamboo segments for discharge at 78 in the form of dried bamboo segments 50*b*.

Figure 8:
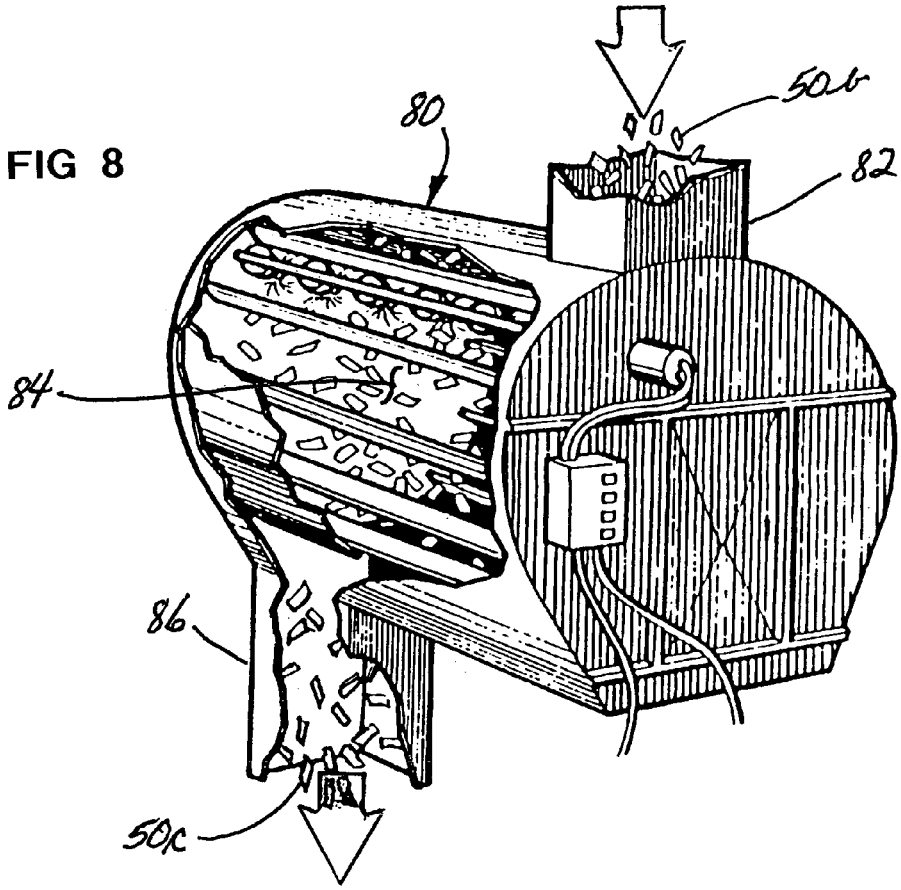
FIG. 8 is a perspective view of the blending and coating of the dried bamboo segments with a suitable adhesive.

In FIG. 8, a glue-applying apparatus 80 receives the dried bamboo segments 50*b* into chute 82. The inner chamber 84 tumbles the bamboo segments 50*b* while a layer or coating of suitable glue is applied over substantially all of the exterior surfaces of the bamboo segments 50*b*. These glue-coated bamboo segments 50*c* are discharged downwardly in the direction of the arrow from discharge chute 86. The preferred glue coating is available from Black brothers in North Carolina.

In FIG. 9, the bamboo segments 50*c* are dispensed by gravity in the direction of arrows J and K into two different portions of a mat-forming apparatus 90. The mat, shown generally at numeral 110, includes multiple layers 100, 102, 104 and 106 of bamboo segments 50*c* which are cross or orthogonally oriented one to another for added strength in the final product. Rollers 96 and 98 orient the bamboo segments 50*c* in a transverse orientation while those bamboo segments 50*c* being dispensed by gravity through chamber 92 onto longitudinally aligned rollers 94 align the bamboo segments 50*c* in the longitudinal direction of the mat 110. Each of the layers 100, 102, 104 and 106 generally have a thickness in the range of about 0.03"–0.06". This equipment, called a Layup Forming Lines machine is available from Dieffenbacher GmbH & Co. KG of Germany.

The assembled mat 110 is then fed into a compressing apparatus 120 similar to that described in U.S. Pat. No. 3,723,230 previously incorporated by reference. This compression apparatus 12 applies high pressure in the range of about 200 p.s.i. and optionally heat, depending on the particular adhesive coating utilized, to fully cure the adhesive and convert the mat 110 into a structurally finished product 110*a* which, in FIG. 11, is then fed into gang saw cutting wheels 122 for proper sizing prior to shipment. Note that the inclusion of heat facilitates the use of a lesser expensive adhesive to achieve a desired consistent superior strength level.

By this process, a very homogeneous bamboo structural product or beam is produced, which has exhibited substantially higher strength ratios than previously achieved by other composite bamboo wood substitute products for the construction industry. A key aspect of this invention and enhanced strength consistency is achieved through the removal of all of the epidermis material from the bamboo stalk segments prior to further processing as above described.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

The invention claimed is:

1. A process of forming a bamboo beam comprising the steps of:

splitting bamboo tubes lengthwise into elongated slats;

removing nodes and husk or epidermis from each outer surface of each said slat and inner membrane or epidermis material from each inner surface of each said slat by passing each said slat between a pair of opposing machining wheels;

compressing, flattening and dewatering said slats by passing said slats between a pair of opposing rollers;

stranding said slats into thin, flat elongated segments by the application of a stranding drum having rotating and inwardly facing blades;

drying said segments;

applying a glue coating to said segments;

arranging said segments into layers, one said layer atop the next, each said layer having said segments oriented generally parallel to one another;

compressing said layers together while said glue cures into a single bonded integral structure.

* * * * *